US005168129A

United States Patent [19]

D'Antonio

[11] Patent Number: 5,168,129

[45] Date of Patent: Dec. 1, 1992

[54] VARIABLE ACOUSTICS MODULAR PERFORMANCE SHELL

[75] Inventor: Peter D'Antonio, Largo, Md.

[73] Assignee: RPG Diffusor Systems, Inc., Upper Marlboro, Md.

[21] Appl. No.: 656,470

[22] Filed: Feb. 19, 1991

[51] Int. Cl.[5] ..... E04B 1/99; E04B 1/82

[52] U.S. Cl. ..... 181/30; 181/295

[58] Field of Search ..... 181/30, 295; 52/144, 52/145

[56] References Cited

U.S. PATENT DOCUMENTS 3,630,309 12/1971 Wenger et al. ..... 181/30
3,908,787 9/1975 Wenger et al. ..... 181/30
4,278,145 7/1981 Eade et al. ..... 181/30

FOREIGN PATENT DOCUMENTS 2828413 2/1979 Fed. Rep. of Germany ..... 181/295

*Primary Examiner*—Russell E. Adams

*Assistant Examiner*—Khanh Dang

*Attorney, Agent, or Firm*—H. Jay Spiegel

[57] ABSTRACT

A performance shell is disclosed which includes a plurality of modular components which may be assembled together to surround a performing entity ranging from a single soloist to a full orchestra. Modular components may be added and subtracted as desired to adapt the size of the shell to the size and type of the performance entity. The structure of the invention includes a plurality of rectangular recesses each one of which is designed to receive an acoustical device such as a reflective device, a diffusive device or an absorbing device. By carefully arranging the locations of these various devices in the shell, the performers will be better able to hear themselves and other musicians resulting in a performance which the audience perceives as louder, being more rhythmically in unison, and containing better loudness balance between sections than would be the case without the features of the shell.

11 Claims, 7 Drawing Sheets

VARIABLE ACOUSTICS MODULAR PERFORMANCE SHELL

BACKGROUND OF THE INVENTION

During solo, band, orchestral or choral performances, there is a need for surfaces or enclosures, conventionally termed acoustical shells, which surround musicians to allow projection of the performance toward an audience and to improve communication among performers. An optimally designed acoustical shell would reinforce and blend the sound projected toward the audience while also heightening the ability of the musicians to hear themselves and the other musicians in the ensemble thereby allowing the musicians to play in unison and with proper loudness balance between sections of the group.

Performance shells designed to enclose a performing group are generally known. However, to Applicant's knowledge, no such shell has ever been devised which contains all of the necessary modular sound absorbing, reflecting and diffusing elements variably configured to enhance the quality of a performance both for the musicians and the listening audience to an optimal degree. Most performance shells now known are merely large structures having walls, ceiling and an opening facing the audience. The walls and ceiling of these shells are normally hard, flat, purely reflective materials or partially diffusive geometrical surfaces offering limited bandwidth diffusion. Broad bandwidth or low frequency absorbing surfaces are rarely included. As such, a need has developed for a performance shell which not only encloses a performing group but also enhances the performance both for the musicians and for the audience.

SUMMARY OF THE INVENTION

The present invention relates to a variable acoustics modular performance shell. The present invention includes the following interrelated objects, aspects and features:

(a) In a first aspect, the present invention includes a plurality of modular components which may be assembled together in a variety of ways depending upon the size and type of the performing group. The example disclosed in the specific description of the preferred embodiment is, generally speaking, of the smallest type, meant for a soloist or small ensemble. This embodiment includes four modular towers and a cantilevered canopy structure.

(b) Each tower includes a plurality of vertically spaced generally rectangular openings formed in a frame structure. Each rectangular opening is designed to receive an acoustical treatment apparatus which is any one of absorbing, reflective or diffusive or combinations thereof.

(c) Acoustic treatment apparatuses which are usable in conjunction with the present invention, removably mountable within the generally rectangular openings of the towers are manufactured and/or distributed by RPG Diffusor Systems, Inc. of Largo, Md. These devices include absorbing acoustical treatment apparatuses such as those sold under the names ABFFUSOR and ABSORBOR as well as reflective acoustical treatment apparatuses such as that which is sold under the name REFLECTOR, diffusing acoustical treatment apparatuses such as those sold under the names QRD DIFFUSOR, OMNIFFUSOR, TERRACE and FLUTTERFREE. Additionally, one may install within a generally rectangular opening an acoustical treatment apparatus known as the TRIFFUSOR which constitutes a plurality of rotatably mounted triangular cross-section devices with each face having a different acoustical treatment apparatus. Thus, one face has a diffusor, a second face has a reflector and a third face has an absorber. A two-sided variable apparatus called a BIFFUSOR having one diffusive and one absorptive side may also be employed.

(d) The towers are arranged in such a manner that they enclose the performing group. At the top of each tower, an angled canopy structure is provided which when combined with the canopy structures of adjacent towers forms a cantilevered canopy structure designed to reflect sounds to the performing group and away therefrom.

(e) Fastening devices are disclosed to releasably hold acoustical treatment apparatuses within the generally rectangular openings in the frame structure of each modular tower. These fastening devices hold an acoustical treatment apparatus within a respective opening free from vibration.

(f) The modular nature of the present invention allows not only ease of expansion of the device to accommodate larger performing groups but also best facilitates disassembly of the inventive device for easy transport from place to place. In the preferred embodiment, the entire device as assembled together consists of a plurality of vertically spaced rows of generally rectangular openings with each row being provided with types of acoustical treatment apparatuses for particular purposes as will be described in greater detail hereinafter.

Accordingly, it is a first object of the present invention to provide a VARIABLE ACOUSTICS MODULAR PERFORMANCE SHELL.

It is a further object of the present invention to provide such a device which may be easily assembled and disassembled for ease in transport and set up.

It is a still further object of the present invention to provide such a device incorporating acoustical treatment apparatuses using QRD mathematical number theory sequences to provide optimal sound diffusion.

It is a further object of the present invention to provide such a device wherein acoustical treatment apparatuses of different types may be selectively installed therein and removed therefrom.

It is a yet further object of the present invention to provide such a device which may easily be expanded in size to accommodate performing groups of differing sizes.

These and other objects, aspects and features of the present invention will be better understood from the following detailed description of the preferred embodiment when read in conjunction with the appended drawing figures.

Applicant herein is coinventor of inventions which are the subject of U.S. patents and pending patent applications as follows: U.S. Pat. No. D/291,601 for an Acoustical Baffle, U.S. Pat. No. D/306,764 for an Acoustical Baffle, application Ser. No. 07/431,831 for a Cinder Block Modular Diffusor, application Ser. No. 07/584,628 for a Cinder Block Modular Diffusor, U.S. Pat. No. 4,821,839 for Sound Absorbing Diffusor.

SPECIFIC DESCRIPTION OF THE PREFERRED EMBODIMENT

Figure 2:
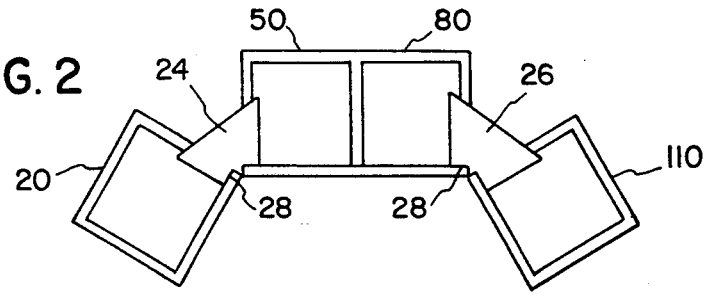
FIG. 2 shows a top view of the present invention with the canopy structure thereof removed to show detail.

With reference to FIGS. 1–7, the present invention is generally designated by the reference numeral 10 and is seen to include modular towers generally designated by the reference numerals 20, 50, 80 and 110. The modular tower 20 is seen to include framing consisting of vertical members 21, 23, 25 and 27 which are interconnected by horizontally disposed generally rectangular framing levels generally designated by the reference numerals 29, 31, 33, 35 and 37 with each level having four tubular framing members combined together.

These structures define four vertically stacked openings generally designated by the reference numerals 39, 41, 43 and 45. The other modular towers have similar or analogous structure to the components described above and, as such, will be described in more general terms for ease of explanation. Thus, the modular tower 50 includes the same framing structure as the modular tower 20 resulting in the creation of openings 51, 53, 55 and 57. In the same manner that the modular tower 20 includes a canopy structure 47, similarly, the modular tower 50 includes a canopy structure 59.

Turning to the modular tower 80, this tower has the same framing structure as the modular towers 20 and 50 and defines openings 81, 83, 85 and 87 as well as canopy structure 89.

Similarly, the modular tower 110 has framing structure which defines openings 111, 113, 115 and 117 as well as the canopy 119.

Figure 1:
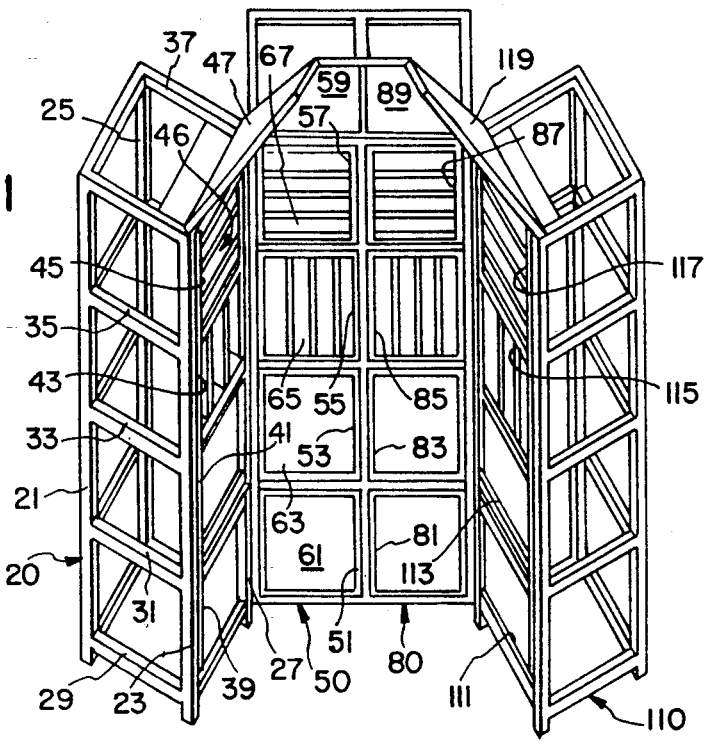
FIG. 1 shows a front perspective view of the present invention.
Figure 4:
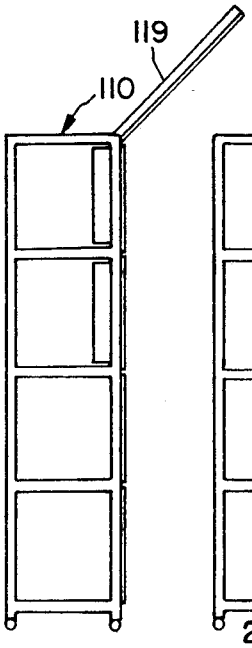
FIG. 4 shows a view from one side of the present invention.

With particular reference to FIG. 1, it is seen that each generally rectangular opening of the modular towers of the inventive device 10 has an acoustical treatment apparatus removably mounted therein. Thus, for example, the modular tower 50 has a reflective device 61 mounted within the opening 51 and a further reflective device 63 mounted within the opening 53, an acoustical diffusor 65 mounted within the opening 55 with its vertical wells designed to scatter sound laterally across the stage, and an acoustical diffusor 67 mounted within the opening 57 having horizontal wells and being designed to scatter sound in the vertical plane. Where risers are used to elevate the rear rows of a chorus, for example, the reflective acoustical treatment apparatuses such as those described above provide half space bass support and the QRD Diffusor apparatuses provide diffusion at ear height. Thus, the sound which would normally rise and be reflected away from the performers instead reflects back downwardly through operation of the diffusor 67 and canopy 59 into the area where the performers are located.

As described above, the canopy 59 is reflective. In the examples shown, the other modular towers have the same corresponding arrangement of acoustical treatment apparatuses. Of course, the arrangement shown in the figures is merely exemplary and particular circumstances and environment may dictate differing arrangements of acoustical treatment apparatuses.

Figure 7:
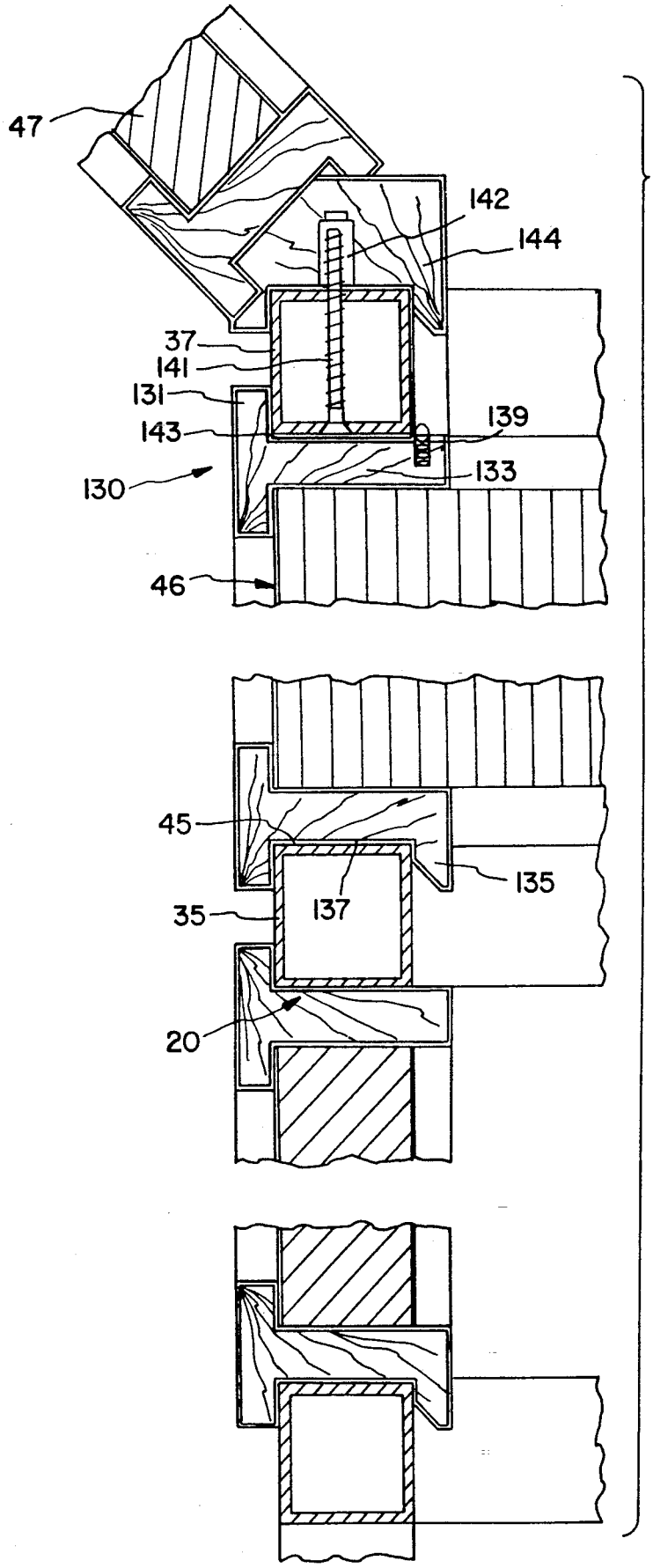
FIG. 7 shows a vertical cross-sectional view illustrating the manner of attachment of acoustical treatment apparatuses to the inventive device.

With particular reference to FIG. 7, an example of a manner of removable installation of an acoustical treatment apparatus within an opening of a modular tower is shown. The example in FIG. 7 which is described hereinbelow is of the opening 45 of the modular tower 20 including framing levels 35 and 37. A diffusor 46 is shown detachably mounted within the opening 45.

For this purpose, a bracket 130 is seen to be of generally T-shaped cross-section with the top of the T being generally designated by the reference numeral 131 and with the leg of the T being generally designated by the reference numeral 133. The bracket 130 is designed to be mounted about the entirety of the periphery of the front face of the acoustical treatment apparatus 46, in this example, a diffusor. In this regard, the bracket 130 is generally rectangular viewed from the front with the T-shaped cross-section extending over portions thereof corresponding to the top and two sides of the acoustical treatment apparatus 46. However, on the bottom of the bracket 130 as seen in FIG. 7, an additional depending leg 135 is provided which creates a channel 137 of U-shaped cross-section. This channel is designed to partially surround the frame member 35 to support the bracket 130 in mounted position while a fastening device such as, for example, the spring loaded ball plunger 139 fastens the top of the bracket 130 to the frame member 37.

A vibration absorbing structure such as the felt piece 143 is provided interposed between the bracket 130 and the framing levels 35, 37 of the modular tower creating the opening 45. In this way, the acoustical treatment apparatus 46 may be mounted in a vibration-free manner while allowing easy disassembly, removal, exchange and replacement thereof. As should be understood by those skilled in the art, the acoustical treatment apparatus 46 is frictionally retained on the bracket 130 by virtue of an interference fit.

The canopy 47 is mounted on the tower 20 through the use of the screw 141 received in the socket 142 of the canopy mounting bracket 144 as shown in FIG. 7.

The individual modular towers may be associated with one another to form a single modular performance shell in any desired manner. The tower 20 is seen to include a plurality of lockable wheels 22 and the other modular towers have corresponding structure. These wheels are designed to support each modular tower in a fixed position in a secure manner while allowing easy positioning and transport.

FIG. 2 shows a manner of interconnection of adjacent modular towers including generally triangular pieces 24, 26 having cut outs 28 angled in such a manner as to interact with the frame members of the individual towers to cause the towers to be related to one another at a desired angular relationship. In the examples shown in FIGS. 1 and 2, in particular, the towers 20 and 110 are angularly related with respect to the adjacent towers 50 and 80 at the angle of 120 degrees.

As explained above, the embodiment illustrated in FIGS. 1–7 is merely exemplary of the manner of implementation of the teachings of the present invention. Thus, for example, the modular towers 50 and 80 may comprise two of ten or more adjacent towers forming a back wall of a modular performance shell with the towers 20 and 110 comprising one of three to five or more adjacent modular towers forming the sides thereof. The particular size of the finished device 10 is dictated by the size of the performing group whether a soloist, an ensemble, a chorus or a full orchestra. Any size performing group may be accommodated in accordance with the teachings of the present invention merely by adding or subtracting modular towers with acoustical treatment devices removably mounted therein in an appropriate manner. Thus, it may be appropriate to adjust the height of each modular tower by adding framing structure to increase the height to accommodate to, for example, risers for a chorus of a plurality of vertically staggered rows. Under such circumstances, it might be contemplated that openings in the frame structure which are behind the risers and thus generally ineffectual be covered with either absorbing or reflecting acoustical treatment apparatuses as desired, with those openings at or above the level of the chorus being provided with appropriate diffusors.

Figure 3:
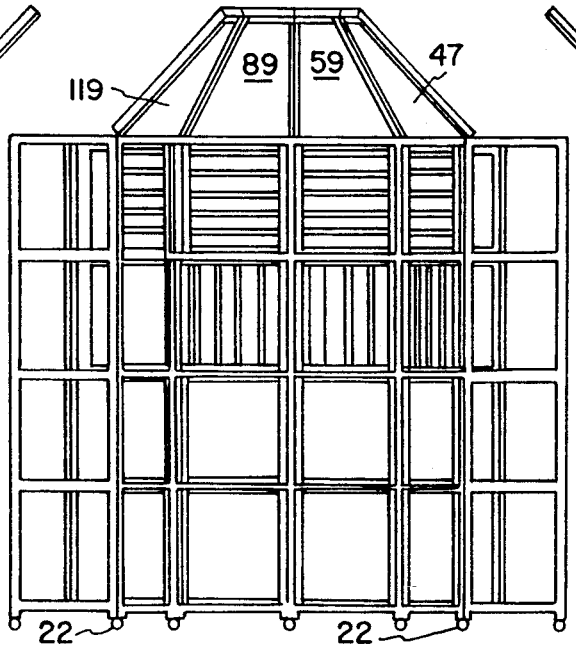
FIG. 3 shows a rear view of the present invention.
Figure 5:
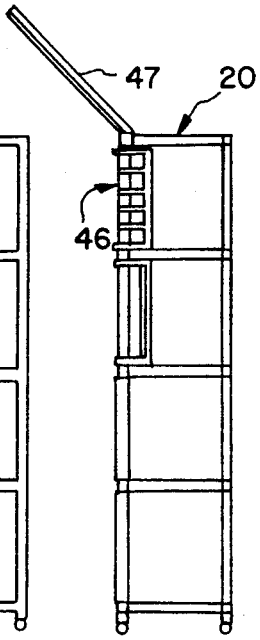
FIG. 5 shows a view from the other side of the present invention with portions in cross-section to show detail.
Figure 6:
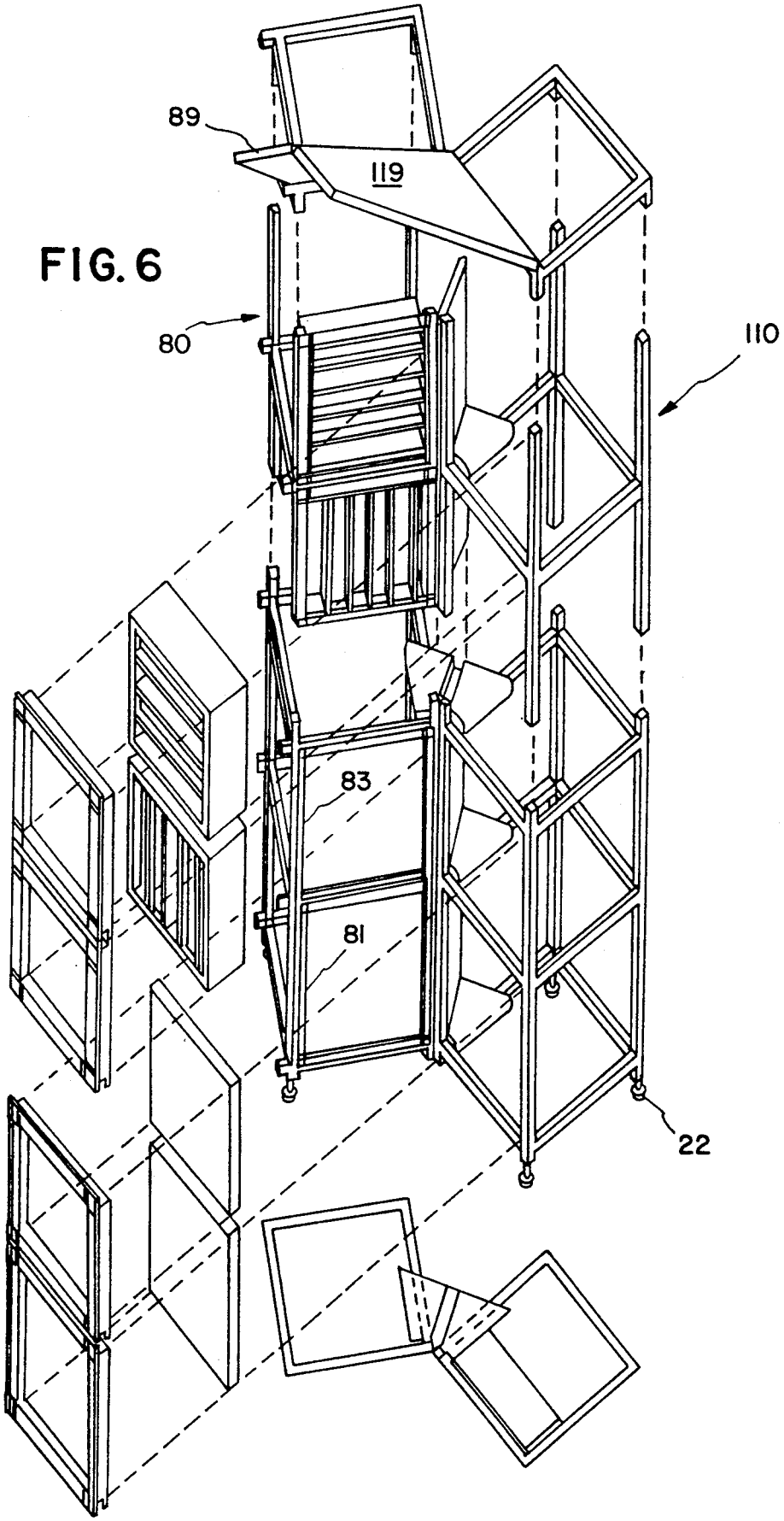
FIG. 6 shows an exploded perspective view of the present invention.

As best seen in FIGS. 1 and 3, the upper sections of each of the individual modular towers are combined together to form a cantilevered canopy designed to serve several functions. Firstly, this canopy reflects sound which would normally be lost in the stage ceiling from the rear of the stage forward. Furthermore, the canopy reflects sounds coming backward from the front of the stage downward to the rear sections thereof to allow members of the performing group in varying areas of the stage to hear one another so that better musical communication takes place. Finally, the canopy reflects sound from the upper diffusors which scatter in the vertical plane back down into the performance area.

In the preferred embodiment of the present invention, each modular tower is made of a lightweight but strong metallic material such as aluminum. In the preferred embodiment, tubular pieces of aluminum are interconnected together by any suitable means such as, for example, using NYLON connectors of varying configurations or bolting to provide the modular tower structures. The important feature in the connecting devices is the fact that they make it easy to assemble, dismantle or expand each tower. Adjacent towers can be independent of one another to provide easy position adjustment and ease of transport even through doorways. Adjacent towers can be economically coupled together for additional stability and may be moved in tandem.

The cantilevered canopy structures best seen in FIGS. 1 and 3 are preferably removably bolted to the rest of each respective modular tower so that they may easily be removed for transport.

Figure 8:
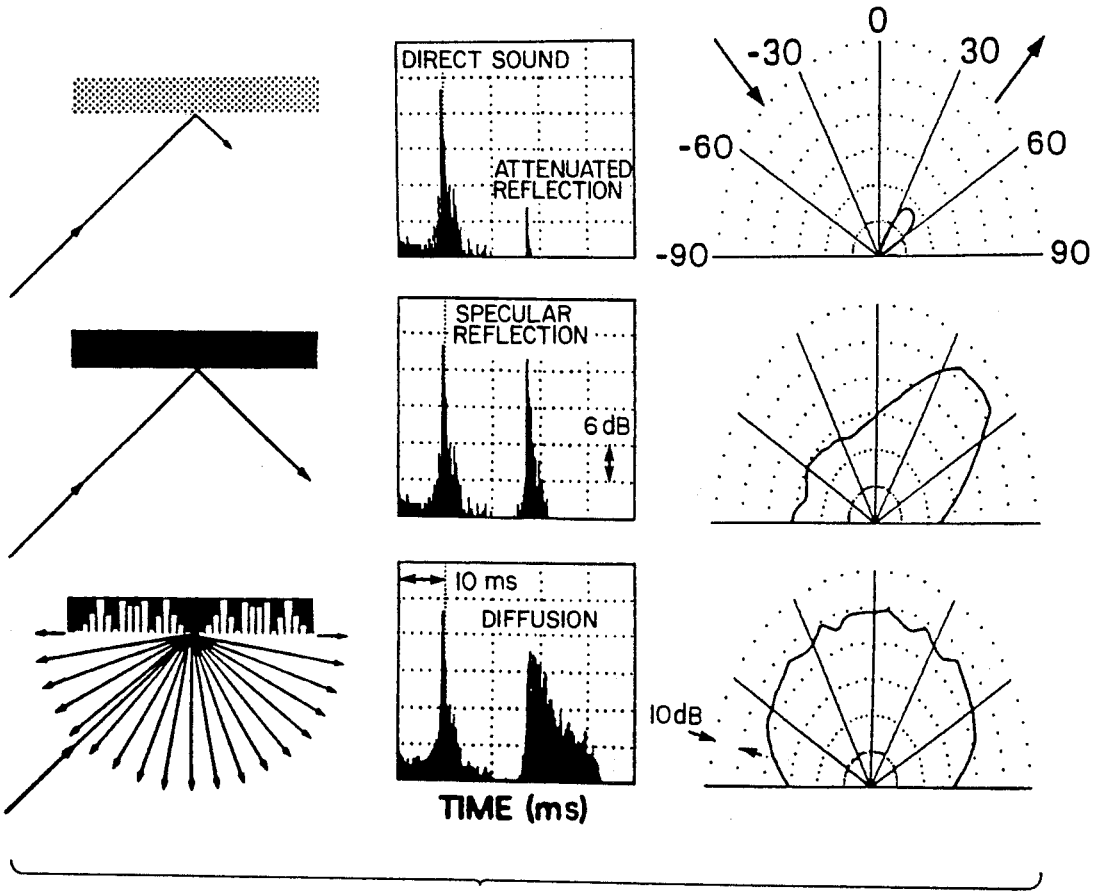
FIG. 8 shows acoustical characteristics resulting from the use of absorptive, reflective and diffusive acoustical treatment apparatuses.

As mentioned earlier, many diverse types of acoustical treatment apparatus may be inserted within the generally rectangular openings formed within each modular tower. Numerous types of acoustical treatment apparatus are manufactured and sold by RPG Diffusor Systems, Inc. of Largo, Md. These devices are manufactured in dimensions designed to be specifically compatible with the openings formed in the modular towers. Among these devices are the following:

a broad bandwidth absorber which simultaneously provides sound diffusion and absorption covered by U.S. Pat. No. 4,821,839, manufactured and sold under the federally registered trademark ABFFUSOR;

a broad bandwidth sound absorber manufactured and sold under the trademark ABSORBOR;

a sound absorber made of sintered glass and having a low frequency absorption bandwidth which may be tailored by varying the air gap behind its panel, this device being manufactured by NDC, Inc. and sold under the trademark NDC ALMUTE;

rigid sound reflector devices sold under the federally registered trademark RPG;

a broad bandwidth wide angle one-dimensional sound diffusor covered by U.S. Pat. No. D/291,601, manufactured and sold under the federally registered trademark QRD;

a high frequency flutter control diffusor having an aesthetically pleasing hardwood molding and manufactured and sold under the soon to be federally registered trademark FLUTTERFREE;

a broad bandwidth wide angle two-dimensional sound diffusor manufactured and sold under the soon to be federally registered trademark OMNIFFUSOR;

a broad bandwidth wide angle two-dimensional sound diffusor manufactured and sold under the trademark TERRACE;

an acoustical module having a plurality of adjacent rotatable devices of triangular cross-section with each face of each device having a unique acoustical property, one face having reflective properties, a second face having absorptive properties and a third face having diffusive properties, manufactured and sold under the federally registered trademark TRIFFUSOR;

a two-sided variable acoustics module with one side having diffusive properties and the other side having absorbent properties, manufactured and sold under the trademark BIFFUSOR. The temporal response and spatial response which results in each case of the use of an acoustical treatment apparatus having absorptive properties, reflective properties or diffusive properties is illustrated in FIG. 8.

Early reflections among musicians greatly improve their sensation of playing as a group if the reflections (1) occur within a temporal window which is dependent on the nature of the musical program material typically between 17 milliseconds and 35 milliseconds, (2) include high frequency content roughly between 500 Hz and 2000 Hz, containing the attack transients which are cues for rhythm and expression and (3) contain a balance of all of the parts in the ensemble at all performance positions thereof. The first condition is easily met by spacing the inventive acoustical shell an appropriate distance from the performers while the second and third requirements depend upon the nature and design of the acoustical surfaces of the shell themselves.

As has been stated above, prior commercial acoustical shells have used flat reflective panels and various forms of surface irregularity such as curved surfaces, polycylindrical and fluted columns and the like to provide sound diffusion. Despite the usefulness of some of the partially diffusive forms of relief ornamentation found in acoustical shells in the prior art, experimental measurements conducted by Applicant reveal limitations in either the uniformity of the spatial response, the degree of independence from the direction of incident sound, the diffusion bandwidth, the temporal density or the frequency response.

Figure 9:
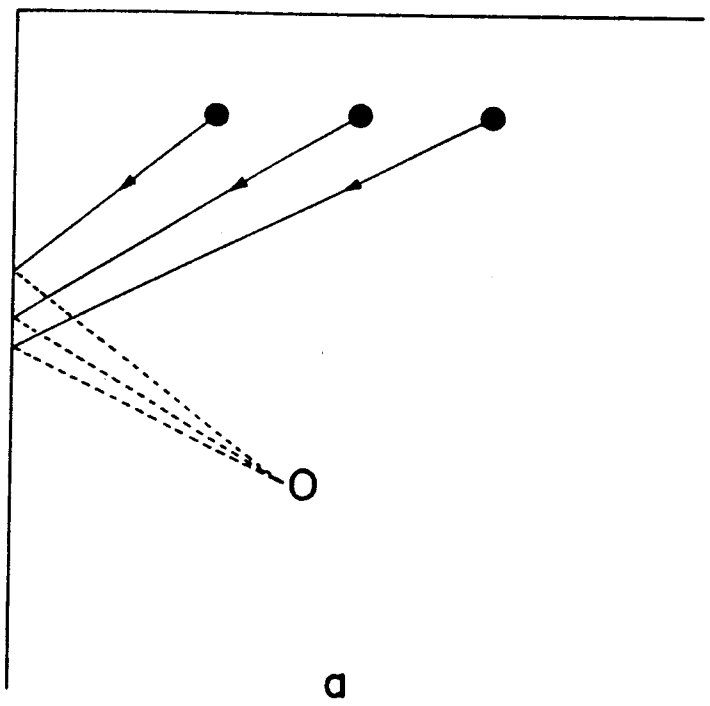
FIG. 9 shows the differences in reflected energy from three sound sources to an observation point from a specularly reflective surface.
Figure 10:
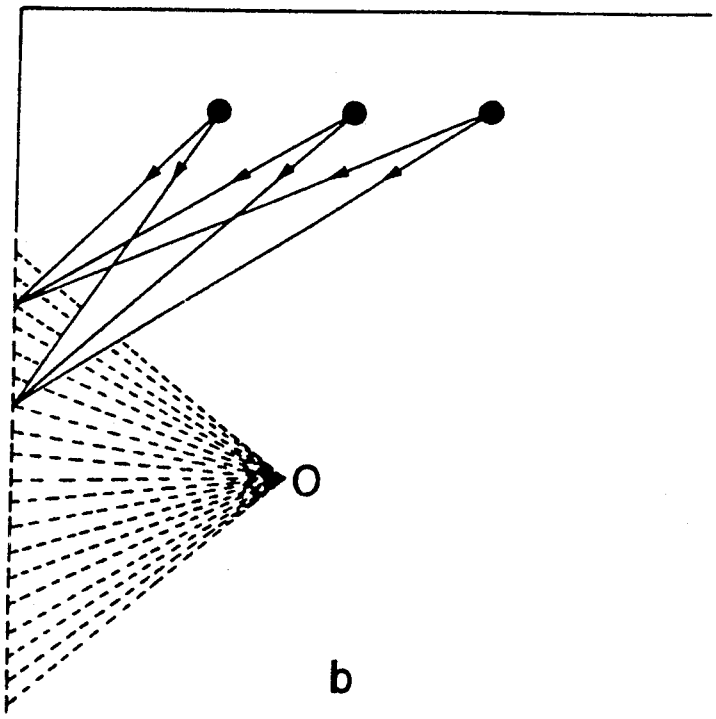
FIG. 10 shows the differences in reflected energy from three sound sources to an observation point from an array of reflection phase grating diffusors.

The present invention utilizes a unique sound diffusing surface based upon mathematical number theory sequences as disclosed in prior patents of which Applicant herein is the coinventor, as listed above, which surface provides optimal surface irregularity for broad bandwidth wide angle scattering. Such surfaces are termed reflection phase gratings. These surfaces provide diffuse reflections covering the essential part of the hearing spectrum to aid ensemble performance and because of the uniform wide angle scattering properties of the surfaces used in accordance with the teachings of the present invention, a well balanced reflection pattern may be provided for all performers located within the inventive acoustical shell. FIG. 10 illustrates the blending and uniform distribution of sounds from each member of the ensemble to all performers, as compared to the lack of such characteristics in a specularly reflective surface as illustrated in FIG. 9.

Each point on a reflecting surface, whether flat or diffusive, can be considered as the source of a spherical wave. When the surface is flat, destructive interference between all of these point emitters occurs in all directions except the specular direction. That is, all energy components in non-specular directions cancel each other. Even though all points on a specular surface are contributing to the scattering process, it is useful to consider a specular reflection as arriving from one point on the boundary which satisfies the condition that the angle of incidence equals the angle of reflection. Consider the indirect energy arriving at the observation point of a performer at (O) from three other performers (dots) reflected off a boundary surface shown in FIG. 9. In FIG. 9 it can be seen that each source is reflected (dotted lines) from only one point, on the specular boundary surface, to the observation point (O). If one or more of these boundary positions is absent or non-reflective, the indirect energy from that source will not reach the observation point. Each observation position receives indirect reflected energy from the three sound sources from different positions on the specular surface. If the specular surface is replaced with an array of reflection phase gratings, as depicted by the vertical dashes in FIG. 10, each diffusor element on the surface has a scattering component (dotted lines) in the direction of the observation position (O), from all sources. This leads to uniform coverage in that all sources are scattered to all observation positions, from all elements on the reflection phase grating surface. The difference between a specular surface and an array of reflection phase gratings, is that each element on the diffusive surface, instead of only one, has a component in the direction of the observation position from all sources, instead of only one.

Figure 11:
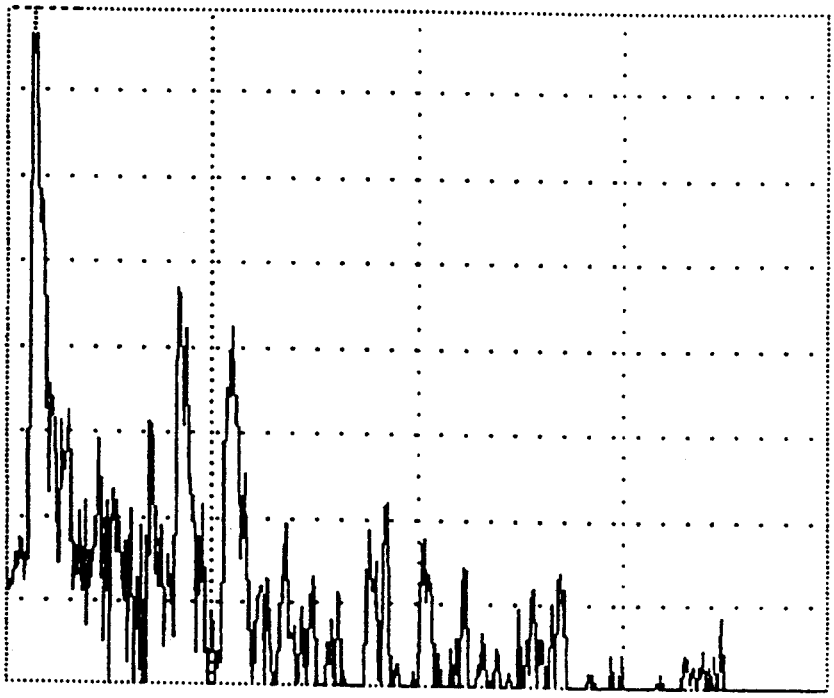
FIG. 11 shows an energy versus time curve illustrating the direct and reflected sound pattern which was measured 3 feet in front of a purely reflective shell such as those known in the prior art.
Figure 12:
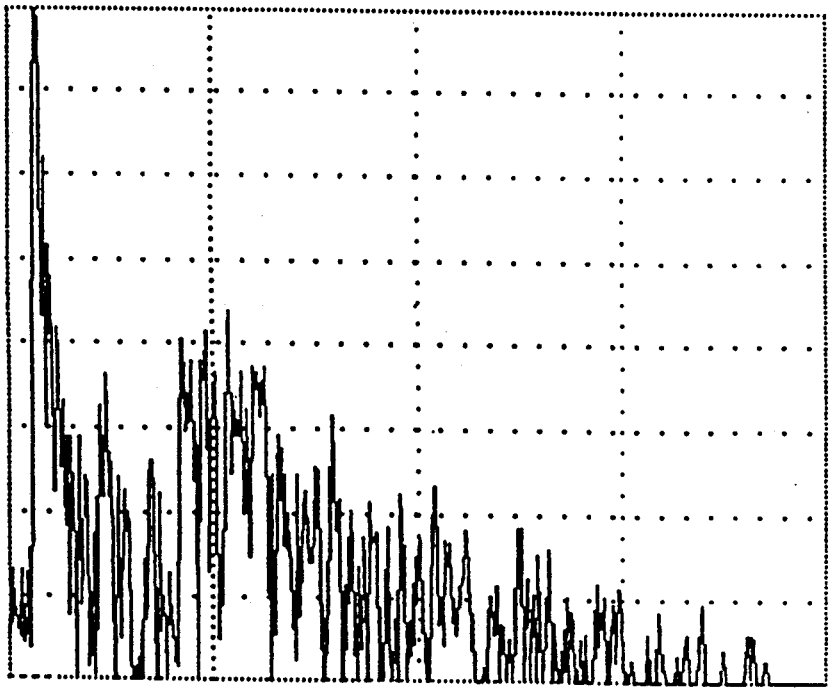
FIG. 12 shows an energy versus time curve illustrating the direct and scattered sound pattern 3 feet in front of an acoustical shell having diffusive properties such as that which is disclosed in this patent application.

To illustrate this fact, the sound scattered from a purely reflective and diffusive shell was measured by Applicant. This was accomplished by placing a loudspeaker/microphone combination in front of each shell. Using a Techron System 12 acoustical analyzer, the direct swept sine wave chirp test signal from the loudspeaker and scattered energy from the shell are measured and displayed in an energy versus time display. The speaker was placed approximately 3 feet in front of the shell and the microphone was placed 18 inches away toward the shell and 3 inches down. In FIG. 11 the direct and reflected sound detected by the microphone in front of a purely reflective shell is shown. The full scale intense reflection at 1.3 ms is the direct sound and the two isolated reflections 8.4 ms and 11.0 ms are the strongest reflections from the shell. FIG. 12 illustrates the diffuse reflection pattern recorded by the loudspeaker/microphone combination in front of a diffusive shell consisting of lower lateral diffusors and upper vertical plane diffusors. Again the direct sound occurs at 1.3 ms, but instead of a few sparse reflections, a rich diffuse sound field beginning at 8.5 ms and extending over a significant period of time is recorded. This measurement documents that the sounds from all performers are scattered from all elements on the RPG surface to all performers.

Figure 13:
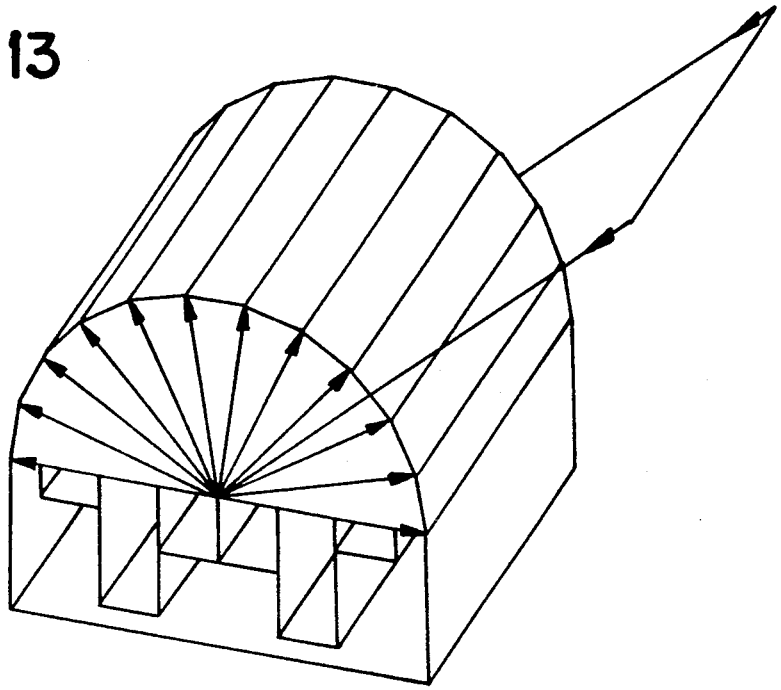
FIG. 13 shows the hemidisk scattering pattern of a plane wave incident at 45 degrees with respect to the surface normal to a one-dimensional QRD DIFFUSOR.
Figure 14:
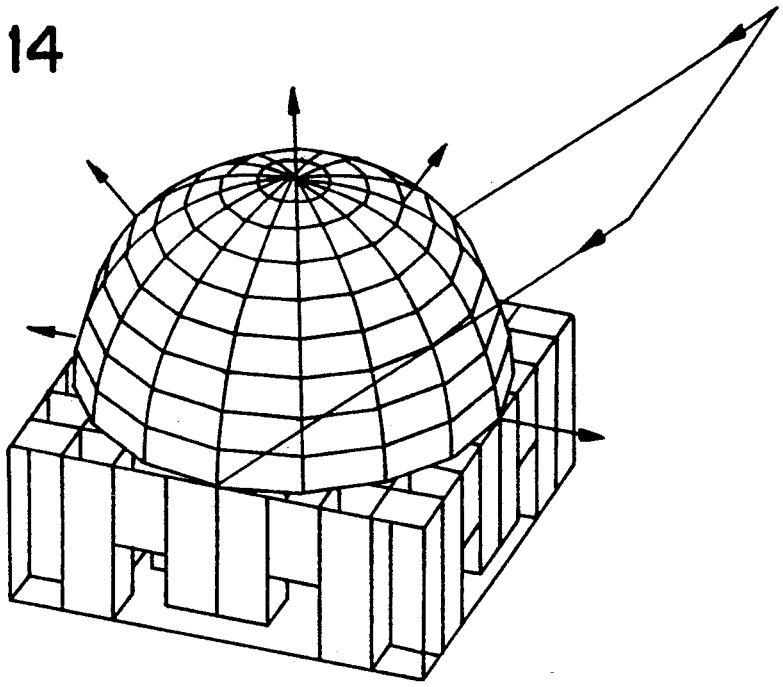
FIG. 14 shows the hemispherical scattering pattern of a plane wave incident at 45 degrees with respect to the surface normal to a two-dimensional OMNIFFUSOR.

The one-dimensional (1-D) RPG consists of a linear periodic grouping of an array of wells of equal width, but different depths, separated by thin dividers. A diffusor based on a quadratic residue number theory sequence is called a QRD DIFFUSOR and is disclosed in U.S. Pat. No. D/291,601. The RPG can also be designed in a two-dimensional (2-D) realization. A 2-D diffusor based on a quadratic residue sequence is called a QRD OMNIFFUSOR and consists of a 2-D array of square, rectangular or circular cells of varying depths, separated by thin dividers. This device is disclosed in U.S. Pat. No. D/306,764. A "male" embodiment of the OMNIFFUSOR without cell dividers is called a TERRACE. The OMNIFFUSOR possesses two vertical mirror planes of symmetry and four-fold rotational symmetry. This symmetry insures that the backscattering is identical in both the horizontal and vertical planes. A schematic comparison between the hemidisk coverage pattern of a 1-D QRD DIFFUSOR and the hemispherical coverage pattern of a 2-D QRD OMNIFFUSOR are shown in FIGS. 13 and 14. In FIG. 13 the incident plane wave is indicated with arrows arriving at 45 degrees with respect to the surface normal thereto. The radiating arrows touching the hemidisk envelope indicate the diffraction directions. In FIG. 14 the incident plane wave is indicated with arrows arriving at 45 degrees with respect to the surface normal thereto. The arrows radiating from the hemisphere envelope indicate a few of the many diffraction directions.

In addition to providing a heightened sense of ensemble and support, the acoustical shell projects sound toward the audience. The shell, in the preferred embodiment thereof, utilizes a stiff lower reflecting section and an upper reflecting canopy to project sound. The reflecting sections are formed from either wood, particle board or laminated paper honeycomb for a lightweight and stiff non-diaphragmatic panel.

Musicians are becoming more sensitive to hearing impairment due to sustained loudness on stage. The inventive shell lowers the impact of loudness by diffusion which uniformly distributes the sound so that the level in any particular direction is diminished. In addition, the modularity allows use of low-frequency or broad-bandwidth sound absorbing modules in the vicinity of high intensity instruments like brass and percussion. Strategically placed absorbing panels also improve ensemble balance and allow musicians to hear more distant softer musical sections.

The ability to add dedicated bass absorbers covering specific frequency ranges or broad-spectrum absorbers provides the ability to tune the shell to the conditions on stage. Thus the frequency balance on stage can be adjusted to a particular music ensemble, musical piece or stage.

The inventive shell provides the performance of a fixed shell in a portable format. The aluminum framing system easily disassembles for packing and transportability and the acoustical modules stack easily. Thus there is no sacrifice in performance for portability.

Due to the modular nature of the inventive system, visual decor can be easily changed by changing the modules. A fabric wrapped face frame may also be supplied for those instances when a monolithic or unobtrusive background is required.

As such, an invention has been disclosed in terms of a preferred embodiment thereof which fulfills each and every one of the objects of the present invention and provides a new and improved VARIABLE ACOUSTICS MODULAR PERFORMANCE SHELL of great novelty and utility.

Of course, various changes, modifications and alternations in the teachings of the present invention may be contemplated by those skilled in the art without departing from the intended spirit and scope thereof. As such, it is intended that the present invention only be limited by the terms of the appended claims.

I claim:

1. A modular variable acoustics performance shell, comprising:

a) a plurality of modular towers located in adjacency, each tower including:

i) a frame structure having a plurality of vertically spaced openings;

ii) each opening having mounted therein an acoustical treatment apparatus having a working surface with a surface configuration having a linear periodic grouping of an array of wells of varying depths configured in accordance with a number theory sequence formula or fractile geometry;

b) said shell being configured to provide optimal diffusion of sounds generated by a performance group located adjacent said shell;

c) each acoustical treatment apparatus being removable from its respective opening and being replaceable with an acoustical treatment apparatus of corresponding structure but having different acoustical characteristics whereby said shell may be acoustically adjusted to optimally suit a particular ensemble, musical piece and/or stage configuration;

d) a canopy extending forwardly of said openings.

2. The invention of claim 1, wherein each said tower is mounted on a plurality of wheels.

3. The invention of claim 1, wherein said towers are detachably interconnected.

4. The invention of claim 1, wherein each acoustical treatment apparatus comprises one or more of an absorptive, a reflective or a diffusive apparatus.

5. The invention of claim 4, wherein at least one acoustical treatment apparatus combines reflective and diffusive properties.

6. The invention of claim 4, wherein at least one acoustical treatment apparatus combines absorptive and diffusive properties.

7. The invention of claim 1, comprising four towers arranged in a generally U-shaped configuration.

8. The invention of claim 1, wherein each acoustical treatment apparatus is removably mounted in a respective opening by a bracket interposed between a respective apparatus and opening.

9. The invention of claim 8, wherein each bracket includes a face overlying an edge of an apparatus and an edge of an opening, and sound absorbing vibration resistant fabric interposed between said bracket and said opening.

10. The invention of claim 1, wherein said openings in at least one tower consist of at least a lower opening and an upper opening, said lower opening removably containing a reflective apparatus and said upper opening containing a diffusive apparatus.

11. An acoustical performance shell, comprising:

a) a housing structure having a plurality of regions defined by a plurality of rows and columns of regions;

b) each region defining an acoustical treatment apparatus having a working surface with a surface configuration having a linear periodic grouping of an array of wells of varying depths configured in accordance with a number theory sequence formula or fractile geometry;

c) said shell being configured to provide optimal diffusion of sounds generated by a performance group located adjacent said shell; and d) a canopy extending forwardly of said apparatuses.

* * * * *